United States Patent [19]

Graser

[11] 4,304,329

[45] Dec. 8, 1981

[54] CROWN SUPPORT CARRIER

[75] Inventor: Earl J. Graser, Monroe, La.

[73] Assignee: Johns-Manville Corporation, Denver, Colo.

[21] Appl. No.: 183,606

[22] Filed: Sep. 2, 1980

[51] Int. Cl.[3] ..... B65D 75/00

[52] U.S. Cl. ..... 206/148; 229/35; 229/89; 229/31 FS; 229/34 R; 206/434

[58] Field of Search ..... 206/148, 149, 151, 434, 206/427, 145; 229/31 R, 31 FS, 32, 34 R, 34 A, 35, 89

[56] References Cited

U.S. PATENT DOCUMENTS

| | | | |
|---|---|---|---|
| 205,531 | 7/1878 | Donahue . | |
| 2,522,597 | 9/1950 | Blandford | 229/35 |
| 2,784,900 | 3/1957 | Bauer | 229/35 |
| 2,798,603 | 7/1957 | Grinspoon . | |
| 2,819,557 | 1/1958 | Clark . | |
| 2,936,070 | 5/1960 | Poupitch . | |
| 3,084,792 | 4/1963 | Poupitch . | |
| 3,156,358 | 11/1964 | Randrup . | |
| 3,156,538 | 11/1964 | Randrup . | |
| 3,410,596 | 11/1968 | Slavin, Jr. . | |
| 3,425,382 | 2/1969 | Johnson . | |
| 3,432,085 | 3/1969 | Lock | 229/35 |
| 3,700,275 | 10/1972 | Deasy . | |
| 3,708,103 | 1/1973 | Evans | 229/35 |
| 3,752,305 | 8/1973 | Hayne . | |
| 3,767,041 | 10/1973 | Graser . | |
| 3,834,750 | 9/1974 | Gauntlett . | |
| 3,871,699 | 3/1975 | Hatfield . | |
| 3,884,354 | 5/1975 | Guenther et al. . | |
| 3,897,873 | 8/1975 | Graser . | |
| 3,912,075 | 10/1975 | Berry . | |
| 3,946,862 | 3/1976 | Klygis et al. . | |
| 4,139,094 | 2/1979 | Berry et al. . | |
| 4,190,149 | 2/1980 | Oliff . | |
| 4,192,445 | 3/1980 | Card | 229/35 |

FOREIGN PATENT DOCUMENTS

| | | |
|---|---|---|
| 505679 | 5/1920 | France . |

*Primary Examiner*—Joseph Man-Fu Moy
*Attorney, Agent, or Firm*—Robert M. Krone; Joseph J. Kelly; Norvell E. Von Behren

[57] ABSTRACT

An improved crown support carrier production blank and erected carrier for use with a plurality of beverage bottles. The production blank and the erected carrier are formed with a plurality of inclined upper side and end panels hingedly attached to a central panel and hingedly attached to a plurality of vertical lower side and end panels. A plurality of T-shaped corner glue tabs are formed in the corners of the production blank and are adhesively secured to the lower side and end panels when the production blank is erected to a completed carrier. The T-shaped glue tabs act as an exceptional reinforcing strip on the corners while their shape and placement are designed to round out or soften the corners rather than have sharp piercing corners typical in prior art carriers. Sunburst bottle receiving openings are positioned in the central panel along with at least one opening for use in carrying the package.

6 Claims, 2 Drawing Figures

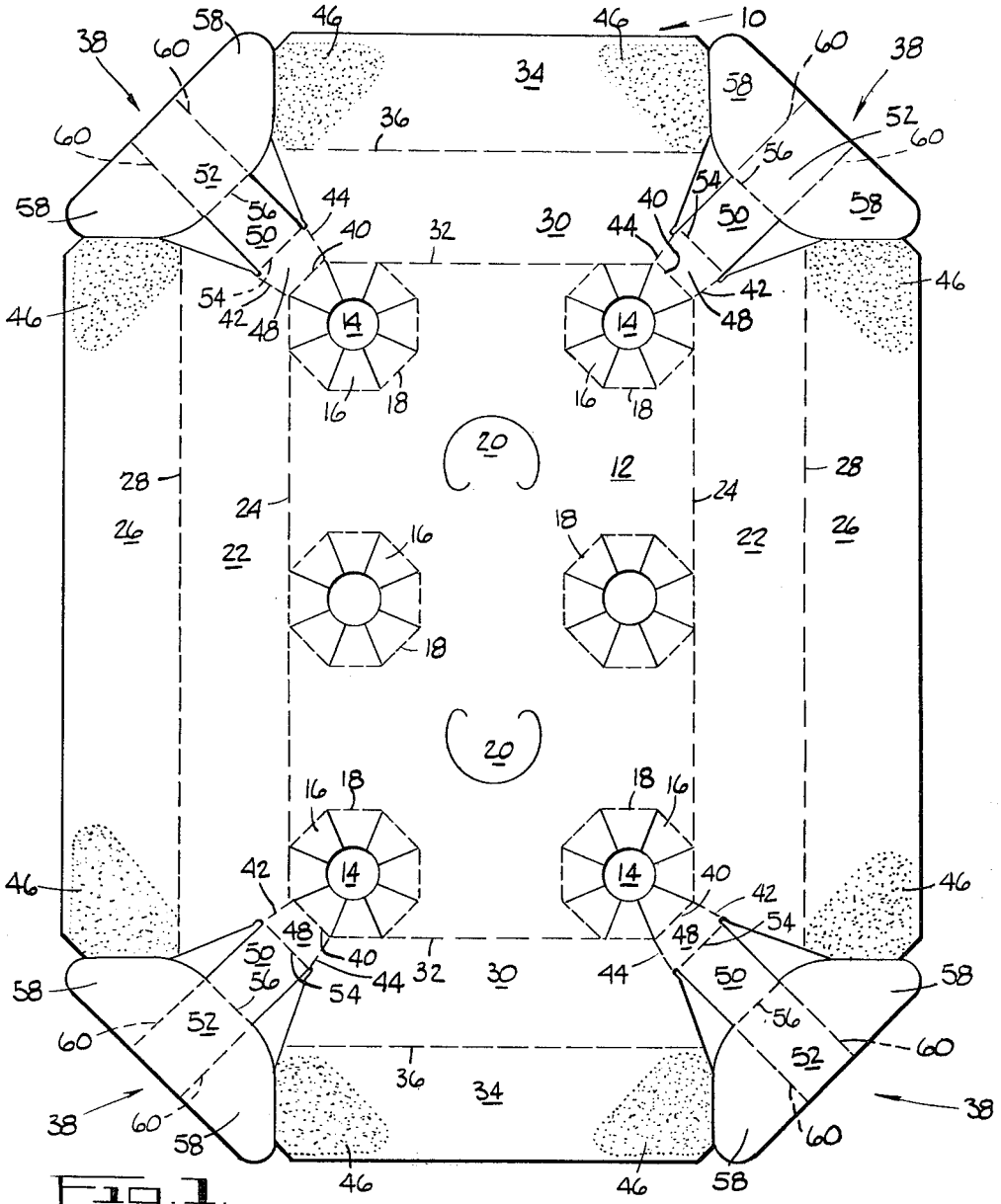
Fig. 1
Fig. 2
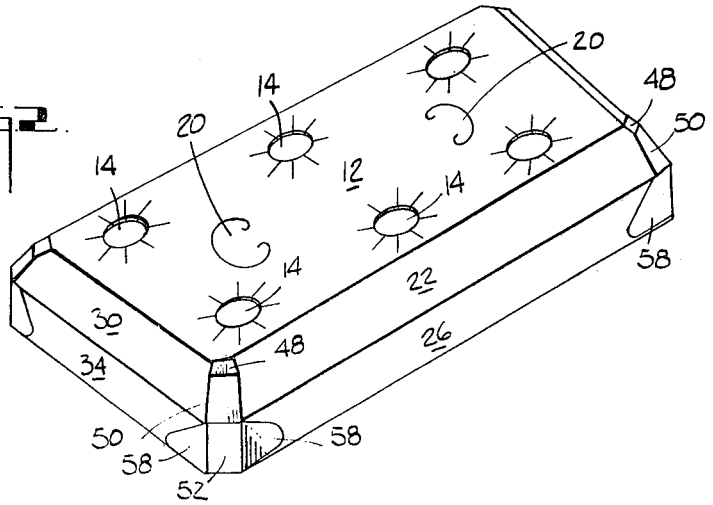

CROWN SUPPORT CARRIER

BACKGROUND OF THE INVENTION

This invention relates generally to crown support carriers and more particularly to an improved crown support carrier production blank and erected carrier having improved corner resistance and improved appearance of the overall package.

It is known in the prior art of crown support carriers to provide a carrier which is positioned over the necks of the bottles to be supported in the carrier with a plurality of sunburst openings holding the bottles within the carrier. Carriers of this type may be made of paperboard, plastic or other suitable materials and may come in a variety of shapes. For example the U.S. Pat. No. 3,700,275, issued Oct. 24, 1972 to Raymond E. Deasy shows a crown cupport carrier having a flat central panel in combination with two downwardly inclined triangular flanges or side panels. Another variation of a typical type of crown support carrier manufactured in plastic would be shown in the U.S. Pat. No. 4,139,094, issued Feb. 13, 1979 to James W. Berry et.al. This carrier is formed from a single rigid plastic sheet and contains a generally sinusoidal type peripheral wall extending downwardly from the outer margins of the flat top panel to merge with a peripheral skirt around the carrier.

The U.S. Pat. No. 4,190,149 issued Feb. 26, 1980 to James R. Oliff et. al. is a paperboard carrier having a flat top surface with a plurality of sunburst features in which downwardly positioned side and end walls are held together by a single anchoring tab positioned at each corner of the carrier.

SUMMARY OF THE INVENTION

The applicants crown support carrier is formed from a single piece production blank and is cut and scored with a sunburst, style bottle neck receiving apertures positioned to lock under the bottle crowns. At each corner of the production blank there is formed a T-shaped tab which is cut to a specific size that will enable it to overlap a side panel and an end panel sufficiently when the blank is shaped in a three-dimensional position. The T-shaped tabs are anchored to those adjacent panels by an adhesive to form an exceptional reinforcing strip on the corners of the package. In addition, the T-shaped tabdesign and placement serves to round out or soften the corners of the package rather than to have a sharp piercing corner as is typical in many prior art carriers and especially in the before referenced U.S. Pat. No. 4,190,149 and U.S. Pat. No. 3,700,275.

Accordingly it is an object and advantage of the invention to provide a production blank for a crown support carrier having a plurality of side panels and end panels which are rigidly held in place by a plurality of T-shaped glue tabs.

Another object and advantage of the invention is to provide an improved crown support carrier having improved corner reinforcement and strength and also having a more appealing appearance especially in the area of the corner of the carrier.

A further object and advantage of the invention is to eliminate sharp or pointed corners on the carrier which is advantageous when the carriers are shrink wrapped.

BRIEF DESCRIPTION OF THE DRAWINGS

FIG. 1 is a top plan view of the production blank of the applicants invention showing the placement of the various panels and also the placement of adhesive on the carrier production blank. The blank is formed of material of conventional thickness as is known in the art of paperboard crown support carriers;

FIG. 2 is a perspective view of the crown support carrier production blank shown in FIG. 1 showing the production blank formed into an erected crown support carrier ready for positioning over the necks of the plurality of beverage bottles.

DESCRIPTION OF THE PREFERRED EMBODIMENT

Referring now to the drawings in general and in particular to FIG. 1 of the drawing there is shown the applicants production blank for a crown support carrier generally by the numeral 10 which comprises a central rectangular shaped panel 12 having a plurality of sunburst bottle neck receiving apertures 14 formed therein by a plurality of sunburst tabs 16 hingedly attached to the central panel 12 by means of the scorelines 18. The central panel 12 has also formed therein at least one finger receiving handle opening formed by the use of the handle opening tab 20 of the type known in the art.

A pair of upper side panels 22 are formed on each side of the central panel 12 by means of the scorelines 24 and a pair of lower side panels 26 are hingedly attached to the upper side panels 22 by means of the scorelines 28.

A pair of upper end panels 30 are hingedly attached to the central panel 12 by means of the scorelines 32 and and also a pair of lower end panels 34 are hingedly attached to the upper end panels 30 by means of the scorelines 36.

Positioned in each corner of the production blank is a T-shaped corner glue tab shown generally by the numeral 38 which is hingedly attached to the central rectangular shaped panel 12 by means of the scorelines 40 as well as to the upper side panels 22 by means of the scorelines 42 and also to the upper end panels 30 by means of the scorelines 44. A controlled amount of adhesive 46 is positioned on the corners of the lower end panels 34 as well as the corners of the lower side panels 26 on one side of the production blank adjacent to the T-shaped corner glue tabs 38.

Referring now to FIG. 2 of the drawing there is shown a perspective of the production blank shown in FIG. 1 showing an erected crown support carrier for positioning over the necks of a plurality of beverage bottles. As has been before mentioned the T-shaped corner glue tabs 38 are positioned on each corner of the production blank and are formed in part from a plurality of three rectangular panels 48, 50 and 52 which are hingedly attached to each other by means of the scorelines 54 and 56. The rectangular panel 48 is also hingedly attached to the central rectangular panel 12 by means of the scoreline 40. A pair of triangular shaped panels 58 are hingedly attached to the rectangular panels 52 by means of the scorelines 60 thereby allowing the triangular shaped panel to be bent and positioned over the adjacent side and end panel and glued in place by means of the adhesive 46 as shown in the FIG. 2 of the drawing. When formed and glued thusly, the T-shaped glue tabs 38 formed in part out of the triangular shaped panel 58 form an exceptional reinforcing strip glueing the lower end panels 34 and the lower side panel 26 securely together. In addition the use of the three rectangular shaped panels 48, 50 and 52 tends to provide a three dimensional corner which is rounded out by the triangular shaped panels 58 to thereby soften the look of the corners of the carrier. This improved corner appearance in combination with the inclined upper side panels 22 and inclined upper end panels 30 along with the vertical lower side panels 26 and lower end panels 34 provides a well rounded appearing crown support carrier having much improved eye appeal to the purchaser. By the use of the inclined upper side panels 22 and upper end panels 30 in combination with the side panels 26 and end panels 34, the erected carrier is able to be nested into other similar carriers thereby simplifying shipment of a plurality of the carriers.

From the foregoing it can be seen that there has been provided an improved crown support carrier production blank and erected carrier satisfying all of the objects and advantages of the invention. Nevertheless changes may be made in the subject production blank and erected carrier and the applicants invention is not to be limited to the specific carrier shown which has been given by way of illustration only.

Having described my invention I claim:

1. A production blank for a crown support carrier, comprising:

(a) a central rectangular shaped panel having a plurality of sunburst bottle neck receiving aperatures therein, the central panel having formed therein at least one finger receiving handle opening;

(b) a pair of upper side panels hingedly attached to the central panel on opposite sides thereof;

(c) a pair of lower side panels hingedly attached to the upper side panels;

(d) a pair of upper end panels hingedly attached to the central panel on opposite sides thereof;

(e) a pair of lower end panels hingedly attached to the upper end panels;

(f) a T-shaped corner glue tab positioned on each corner of the production blank and hingedly attached to the central rectangular panel as well as to the upper side panel and to the upper end panel; and (g) an adhesive positioned on the corners of the lower end panels and the corners of the lower side panels on one side of the production blank adjacent to the T-shaped corner glue tabs.

2. The production blank for a crown support carrier as defined in claim 1 wherein the T-shaped corner glue tabs are formed in part from a plurality of three rectangular panels hingedly attached to each other with one of the panels hingedly attached to the central rectangular panel as well as the upper side panel and the upper end panel.

3. The production blank for a crown support carrier as defined in claim 2 further comprising the T-shaped corner glue tabs comprising in part a pair of triangular shaped panels hingedly attached to one of the three rectangular panels.

4. An erected crown support carrier for positioning over the necks of a plurality of beverage bottles, comprising:

(a) a horizontally positioned rectangular shaped central panel having a plurality of sunburst bottle neck receiving aperatures therein, the central panel having formed therein at least one finger receiving handle opening;

(b) a pair of inclined upper side panels hingedly attached to the horizontal central panel on opposite sides thereof;

(c) a pair of vertically positioned lower side panels hingedly attached to the inclined upper side panels;

(d) a pair of inclined upper end panels hingedly attached to the horizontal central panel on opposite sides thereof;

(e) a pair of vertical lower end panels hingedly attached to the inclined upper end panels;

(f) a T-shaped corner glue tab positioned on each corner of the production blank and hingedly attached to the horizontal central rectangular panel as well as the inclined upper side panels and the inclined upper end panels; and (g) an adhesive positioned on the corners of the lower end panels and the lower side panels adjacent to the T-shaped corner glue tabs and adhesively securing the T-shaped corner glue tabs to the adjacent lower end panels and lower side panels.

5. The erected crown support carrier as defined in claim 4 further comprising the T-shaped corner glue tabs being formed in part from a plurality of three rectangular panels hingedly attached to each other with one of the panels hingedly attached to the central rectangular panel as well as the upper side panel and the upper end panel.

6. The erected crown support carrier as defined in claim 5 further comprising the T-shaped corner glue tabs further comprising in part a pair of triangular shaped panels hingedly attached to one of the three rectangular panels and being adhesively secured to the plurality of vertical side panels and vertical end panels.

* * * * *